US011202927B2

(12) United States Patent
Szocsne Varga

(10) Patent No.: US 11,202,927 B2
(45) Date of Patent: Dec. 21, 2021

(54) INSTALLED FIRE EXTINGUISHING EQUIPMENT WITH IMPROVED CHARACTERISTICS

(71) Applicant: Swiss Fire Protection Research & Development AG, Sarnen (CH)

(72) Inventor: Ilona Szocsne Varga, Budapest (HU)

(73) Assignee: Swiss Fire Protection Research & Development AG, Sarnen (CH)

( * ) Notice: Subject to any disclaimer, the term of this patent is extended or adjusted under 35 U.S.C. 154(b) by 81 days.

(21) Appl. No.: 16/735,260

(22) Filed: Jan. 6, 2020

(65) Prior Publication Data

US 2020/0139171 A1 May 7, 2020

Related U.S. Application Data

(63) Continuation of application No. PCT/IB2017/054065, filed on Jul. 6, 2017.

(51) Int. Cl.
*A62C 3/06* (2006.01)
*A62C 35/68* (2006.01)

(52) U.S. Cl.
CPC ..... *A62C 3/065* (2013.01); *A62C 35/68* (2013.01)

(58) Field of Classification Search
CPC ..... A62C 3/065; A62C 35/68
USPC ..... 169/5, 9, 66; 239/124, 127, 142, 143
See application file for complete search history.

(56) References Cited

FOREIGN PATENT DOCUMENTS

| | | |
|---|---|---|
| EP | 1075316 A1 | 2/2001 |
| WO | 2015181575 A1 | 12/2015 |

OTHER PUBLICATIONS

International Search Report and Written Opinion issued by the International Searching Authority dated Nov. 7, 2017 for corresponding International Patent Application No. PCT/IB2017/054065.

International Preliminary Report on Patentability issued by the International Bureau dated Jan. 7, 2020 for corresponding International Patent Application No. PCT/IB2017/054065.

*Primary Examiner* — Christopher S Kim
(74) *Attorney, Agent, or Firm* — Smith & Hopen, P.A.

(57) ABSTRACT

A fire extinguishing equipment with improved characteristics which includes a pressure-resistant storage body with an internal space that houses a fire extinguishing composition. A monitoring unit is connected to the storage body to measure and regulate one or more physical characteristics. At least one discharge outlet is in communication with the internal space of the storage body and is configured to discharge the fire-extinguishing composition from the internal space to a use location. A charging inlet is disposed within the storage body and is configured to fill the internal space with the fire-extinguishing composition. An extinguishing-launching part-unit is inserted into a pipe section between the use location and the discharge outlet.

11 Claims, 2 Drawing Sheets

INSTALLED FIRE EXTINGUISHING EQUIPMENT WITH IMPROVED CHARACTERISTICS

CROSS-REFERENCE TO RELATED APPLICATIONS

This nonprovisional application is a continuation of and claims priority to international patent application No. PCT/IB2017/054065, entitled "Installed fire extinguishing equipment with improved characteristics," filed Jul. 6, 2017 by the same inventor.

BACKGROUND OF THE INVENTION

The subject of the invention relates to installed fire extinguishing equipment with improved characteristics, which has a pressure-resistant storage body with an internal space serving for accommodating a fire-extinguishing material composition. Furthermore, a monitoring unit is connected to the storage body serving for measuring and regulating one or more physical characteristics. At least one discharge outlet is connected to the internal space of the storage body and is suitable for discharging the fire-extinguishing material composition from the internal space of the storage body to the use location. A charging inlet serving is included for filling the internal space of the storage body with the fire-extinguishing material component or composition, and an extinguishing-launching part-unit is inserted into the pipe section between the use location and the discharge outlet.

Numerous solutions have been created for the protection of various places that pose a risk of fire. A group of these solutions relates to the fire extinguisher device itself, such as its structure and location, while another group relates to the extinguishing medium used for extinguishing the fire. Patent specification registration number HU213496 presents an effective foam material that may be placed in fire extinguishers, for example, and patent specification registration number HU 223507 presents the realization of a fire-extinguishing equipment group that extinguishes with a foam charge.

Also known is WO 2015/181575, which relates to an equipment group extinguishing with foam—serving for protecting storage tanks for storing hydrocarbon derivatives, such as oils—the storage body of which is a large-diameter pipeline, and a multi-component fire extinguishing foam charge is located in the pipeline in a closed pressurized space. The advantage of this solution is that it is suitable for protecting sparsely distributed endangered storage tanks. Its disadvantage, however, is that it does not ensure the conditioning of the extinguishing foam composition located in the pipeline, which is a fundamental condition of the operability of the equipment. During the dormant period, the extinguishing foam composition located in the pipeline separates into gas phase and liquid phase parts due to the solubility of the propellant gas in the case of a drop of pressure or fluctuations in temperature, and therefore its discharge while extinguishing a fire meets with difficulties, and may even be impossible. The first charging of the extinguishing foam composition or the repeated mixing of the extinguishing foam with propellant gas is not possible in this case.

The objective with the invention was to overcome these deficiencies of the known devices and to create a version that, on the one part, makes it possible to continuously condition the extinguishing foam composition in the vessel serving for storing the extinguishing material, and along with this to maintain the continuous operability of the device; and, on the other part, to make the process of producing the extinguishing foam more reliable. A further objective was for it to be possible to simply and quickly connect the unit performing the conditioning to the fire-extinguishing equipment group and to form an entire unit with it.

The recognition that led to the structure according to the invention was that if, unlike the known solutions, the storage body serving for storing the extinguishing foam, apart from the usual connections linked to the internal space (such as the charging inlet for filling the extinguishing foam component or composition and the discharge outlet suitable for transporting the extinguishing foam used when extinguishing fires to the protected place of use), is fitted with at least one circulation outlet that is suitable for transporting the foam stored in the storage body to the composition conditioning unit, and if this circulation outlet is connected with the inlet of a uniquely structured circulation unit and the outlet of the given circulation unit is connected in a novel way with the internal space of the storage body under given geometrical conditions, then, using this unique circulation unit, the fire-extinguishing material composition located in the internal space of the storage body may be entirely moved and mixed, its composition may be optionally changed, e.g. it may be mixed with a gas phase component, and in this state it may be returned to the internal space of the storage unit, and so the task may be solved.

BRIEF SUMMARY OF THE INVENTION

In accordance with the set objective, the installed fire extinguishing equipment with improved characteristics which has a pressure-proof storage body with an internal space serving for accommodating a fire extinguishing material composition; a monitoring unit connected to the storage body serving for measuring and regulating one or more physical characteristics; at least one discharge outlet also connected to the internal space of the storage body and suitable for discharging the fire-extinguishing material composition from the internal space of the storage body to the use location; a charging inlet serving for filling the internal space of the storage body with the fire-extinguishing material component or composition, and an extinguishing-launching part-unit is inserted into the pipe section between the use location and the discharge outlet—is set up in such a way that the storage body is coupled with a pressure-proof circulation unit, which is designed for at least the working pressure of the storage body, where the circulation unit has a feed stub, return stub, and a circulation pipe located between these two, and a circulation pump and a gas inlet fitting are installed in the circulation pipe, a gas tank containing at least the gas phase component of the fire extinguishing material composition is connected to the gas inlet fitting, while the storage body is supplemented with a circulation outlet for returning the fire extinguishing material composition stored in the internal space of the storage body into the circulation unit, the feed stub of the circulation unit is connected to the charging inlet of the storage body, or is independently connected to the internal space of the storage body, and the return stub of the circulation unit is connected to the circulation outlet of the storage body.

A further feature of the installed fire extinguishing equipment according to the invention may be that the charging inlet of the storage body is located on the upper part of the boundary of the storage body, such as on the top of the boundary of the storage body, while the circulation outlet of the storage body is located on the lower part of the boundary of the storage body, such as on the base of the boundary of the storage body.

In another embodiment of the installed fire extinguishing equipment, the feed stub of the circulation unit is connected to the internal space of the storage body via the upper part of the boundary of the storage body, preferably via the top of the boundary of the storage body.

From the point of view of the invention it may be preferable if a manometer part-unit is installed in the circulation pipe of the circulation unit. Optionally, the gas tank is connected to the gas inlet fitting with the interposition of a pressure regulation part-unit and/or shut-off fitting.

In an embodiment of the installed fire extinguishing equipment, the storage body is established as a tank, or as an elongated pipeline containing pipe sections at angles to each other different to a straight angle, where the one end of the pipeline and the other end of the pipeline are sealed off with an end member, the charging inlet of the storage body is arranged near to the one end of the pipeline forming the storage body, while the circulation outlet of the storage body is arranged near to the other end of the pipeline forming the storage body in the boundary. Optionally, the storage body is formed by a closed pipeline returning to itself, where the charging inlet and the circulation outlet are arranged close to one another but separated by a distance in the boundary of the pipeline, and a separation fitting is installed in the storage body between the charging inlet and the circulation outlet, and in this way the internal space of the storage body is divided between the charging inlet and the circulation outlet.

In another embodiment, one or more space-dividing fittings are interposed in the pipeline, and in this way the internal space of the pipeline is divided into one or more space-parts depending on the position of the space-dividing fitting.

In an embodiment of the installed fire extinguishing equipment, the gas inlet fitting has a nozzle that distributes the gas component of the fire extinguishing material composition into the other components of the fire extinguishing material composition.

In another embodiment, a supply stub fitted with a closing fitting is connected to the circulation pipe of the circulation unit, and at least one component of the fire extinguishing material composition except the gas component is introduced into the circulation pipe of the circulation unit through the supply stub.

The installed fire extinguishing equipment according to the invention has numerous advantageous features. The most important of these is that different to the solutions known of, the uniquely structured circulation unit connected to the storage body makes effective and reliable fire extinguishing with extinguishing foam possible for protected use locations that are spread out over an extensive area and separated from each other by larger distances.

A further advantage of its use is that from time to time the composition charged into the storage body and stored there for the purpose of fire extinguishing may be mixed and conditioned, and so malfunctions and even the equipment's inability to extinguish fires may not occur due to the "disintegration" of the foam material.

Another feature that must be listed among the advantages is that due to the novel circulation unit, the amount of the gas phase of the composition, and so the pressure maintained in the storage body may be always kept at the appropriate level, which further improves the effectiveness of the entire installed fire extinguishing equipment, and it also makes its maintenance simpler.

A further, economic, advantage derived from the above is that with the more reliable installed fire extinguishing equipment according to the invention, fires occurring at protected use locations may be extinguished in a shorter time, with the use of less extinguishing material in a given case, which due to the lower financial damage and more preferable operation costs may result in significant savings.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
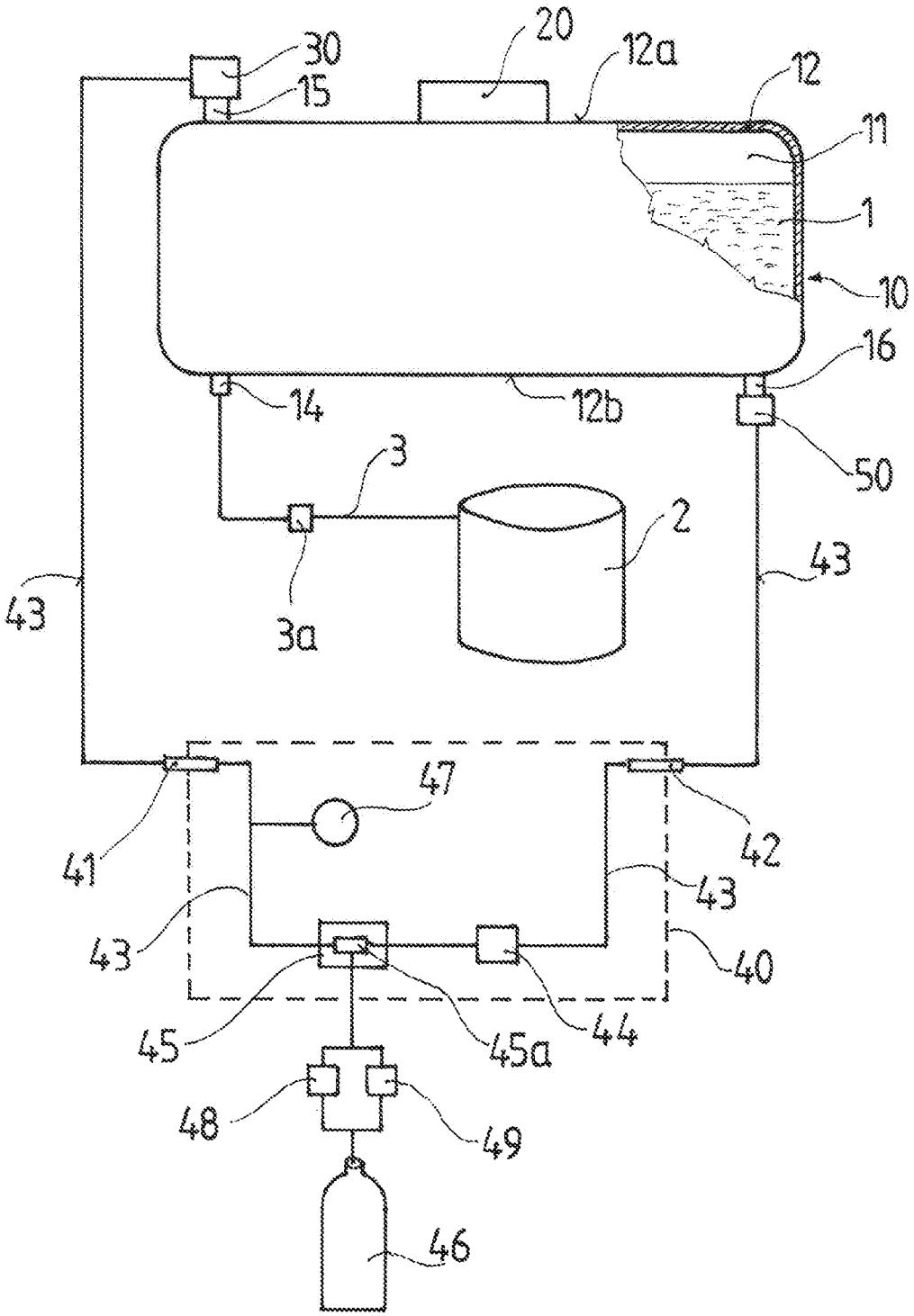
FIG. 1 shows a schematic picture of a possible version of the installed fire extinguishing equipment supplied with a circulation unit according to the invention.

FIG. 1 presents a version of the installed fire extinguishing equipment according to the invention in the case of which the storage body 10 is a tank established as a commonly shaped pressure vessel. It can be seen that the fire extinguishing material composition 1 is located in the internal space 11 of the storage body 10, which does not completely fill the internal space 11 of the storage body 10. The monitoring unit 20 serving for measuring and displaying the physical and, optionally, chemical properties related to the operation of the storage body 10 is connected to the external surface of the boundary 12 of the storage body 10, here to its top 12*a*.

The charging inlet 15 is also located on the top 12*a* of the boundary 12 of the storage body 10, which is fitted with a charging flow regulation body 30, such as a regulation valve. However, the discharge outlet 14 that is connected to the pipe section 3 leading to the use location 2 is located on the base 12*b* of the boundary 12 of the storage body 10. The extinguishing-launching part-unit 3*a* is interposed in the pipe section 3 in the interest of being able to transport the fire extinguishing material composition 1 to the use location 2 through the pipe section 3 in the case of a fire occurring at the use location 2. It is obvious that the storage body 10 does not only have to have one single discharge outlet 14. Preferably the number of discharge outlets 14 may be equal to the number of use locations 2 to be protected.

The circulation outlet 16 may also be found on the base 12*b* of the boundary 12 of the storage body 10, which is fitted with a circulation flow regulation body 50, such as a shut-off valve. It must be mentioned here that the positioning of the charging inlet 15 and the circulation outlet 16 on the storage body 10 is preferable from the point of view of operation but, but in the case of the observance of safe operation requirements, other arrangements are also conceivable.

With the help of the circulation pipe 43, the circulation unit 40 forming the essence of the invention is interposed between the charging inlet 15 and circulation outlet 16 belonging to the storage body 10. The circulation unit 40 has a feed stub 41 and a return stub 42. With the help of a section of the circulation pipe 43 in a way that allows flow, the feed stub 41 is connected to the charging inlet 15 of the storage body 10, while the return stub 42 is connected to the circulation outlet 16 of the storage body 10 through another piece of the circulation pipe 43.

The circulation pump 44 and the nozzle 45*a* of the gas inlet fitting 45 are connected to the section of the circulation pipe 43 between the feed stub 41 and return stub 42 of the circulation unit 40, as is the manometer part-unit 47 in the case of this embodiment. The gas tank 46, which is filled with the gaseous medium required for the production of the extinguishing foam forming the fire extinguishing material composition 1, is connected to the nozzle 45*a* of the gas inlet fitting 45 with the interposition of the pressure regulation part-unit 48 and the shut-off fitting 49. The task of the manometer part-unit 47, the pressure regulation part-unit 48, and the shut-off fitting 49 is to regulate the introduction of the gaseous material stored in the gas tank 46 into the circulation pipe 43 in the desired way.

However, it must be mentioned here that the feed stub 41 and the return stub 42 do not necessarily each form an independent component. A structural arrangement is also conceivable where, for example, where the feed stub 41 is a connection piece of the gas inlet fitting 45, while the return stub 42 is the inlet of the circulation pump 44. Accordingly, the interpretation of the feed stub 41 and the return stub 42 may vary between wide limits in the case of the given invention and rather a theoretical borderline should be indicated as a concrete structural element.

Figure 2:
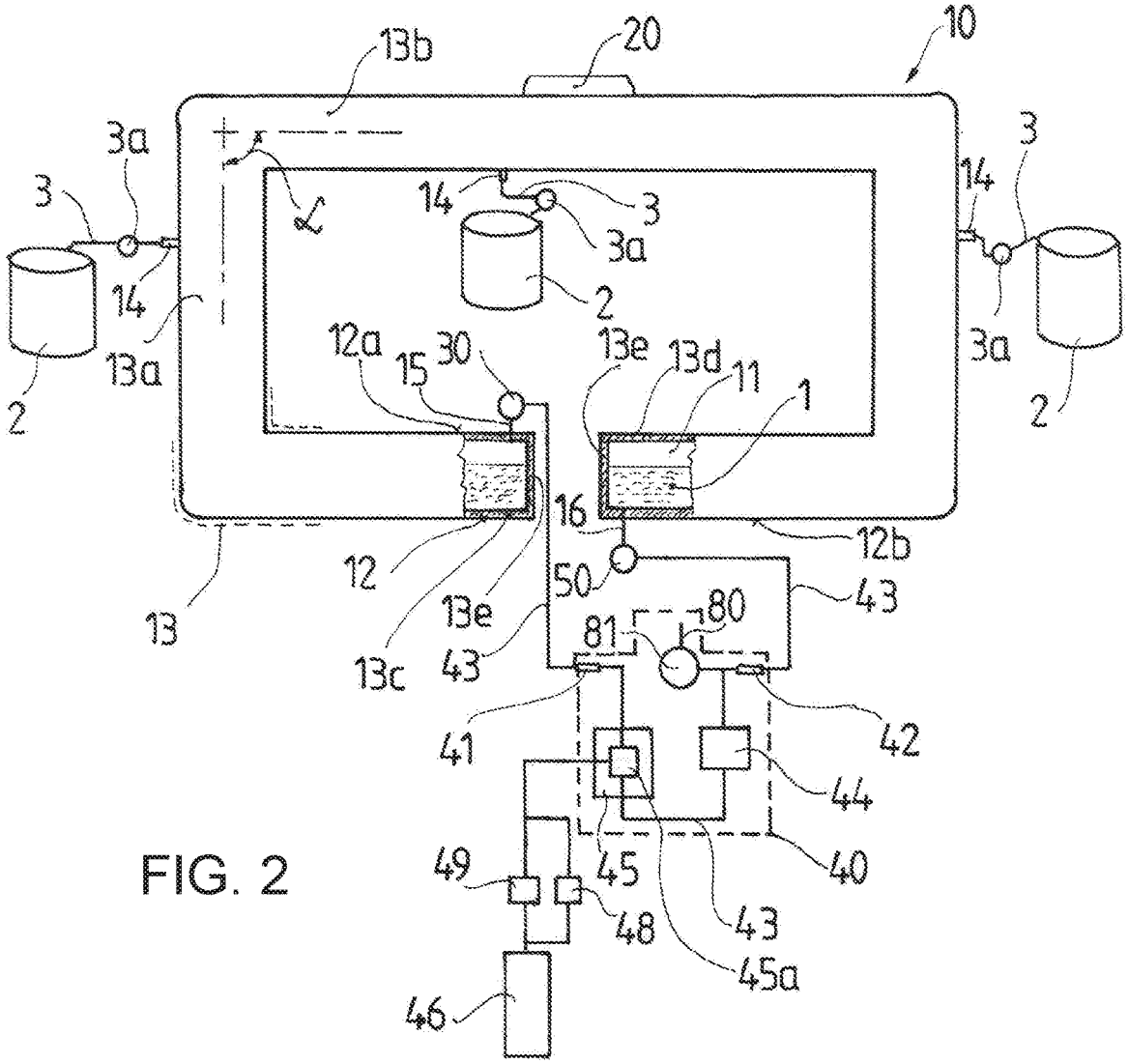
FIG. 2 shows a schematic picture of another version of the installed fire extinguishing equipment supplied with a circulation unit according to the invention.

Moving over now to FIG. 2, it illustrates an embodiment of the installed fire extinguishing equipment according to the invention in the case of which the storage body 10 is established as a pipeline 13 installed along a desired route, and the given pipeline is preferably embedded in the ground along its route between the use locations 2. The pipeline 13 comprises pipe sections 13*a* and pipe sections 13*b*, which are at a wide range of angles "α" to each other deviating from 0°, but the one end 13*c* and the other end 13*d* of the pipeline 13 are preferably located close to one another. The one end 13*c* of the pipeline 13 and the other end 13*d* of the pipeline 13 are each sealed with a gas-tight seal with an end member lie, and so the one end 13*c* and the other end 13*d* of the pipeline 13 are completely separated from each other.

Here also the pipeline 13 has discharge outlets 14, which are connected to the pipe sections 3 fitted with extinguishing-launching part-units 3*a*. The task of the pipe section 3 is to transport the fire extinguishing material composition 1 located in the internal space 11 of the pipeline 13 to the use locations 2.

The pipeline 13 seen in FIG. 2 is connected to the circulation unit 40 in such a way that via individual sections of the circulation pipe 43, the feed stub 41 of the circulation unit 40 is connected to the charging inlet 15 provided with a charging flow regulation body 30, while the return stub 42 of the circulation unit 40 is connected to the circulation outlet 16 that has a circulation flow regulation body 50. In the given embodiment, the charging input 15 is built into the boundary 12 of the pipeline 13 on the top 12*a* of the boundary 12 at the one end 13*c* of the storage body 10 established as a pipeline 13, while the circulation outlet 16 is built into the boundary 12 of the pipeline 13 on the base 12*b* of the boundary 12 at the other end 13*d* of the pipeline 13.

In the case of the embodiment according to FIG. 2, the circulation unit 40 also has a circulation pump 44 and gas inlet fitting 45 installed in the circulation pipe 43. Here, however, a supply stub 80 fitted with a shut-off fitting 81 is also installed in the circulation pipe 43. It is the task of this supply stub 80 to make it possible for at least one component that is not the gas component of the fire extinguishing material composition 1 to be introduced into the circulation pipe 43 of the circulation unit 40 through the supply stub 80.

Naturally, here also the gas inlet fitting 45 of the circulation unit 40 is connected to the gas tank 46. Also, the pressure regulation part-unit 48 and the shut-off fitting 49 serving the appropriate and safe operation of the gas tank 46 are installed in the pipe between the gas inlet fitting 45 and the gas tank 46.

Figure 3:
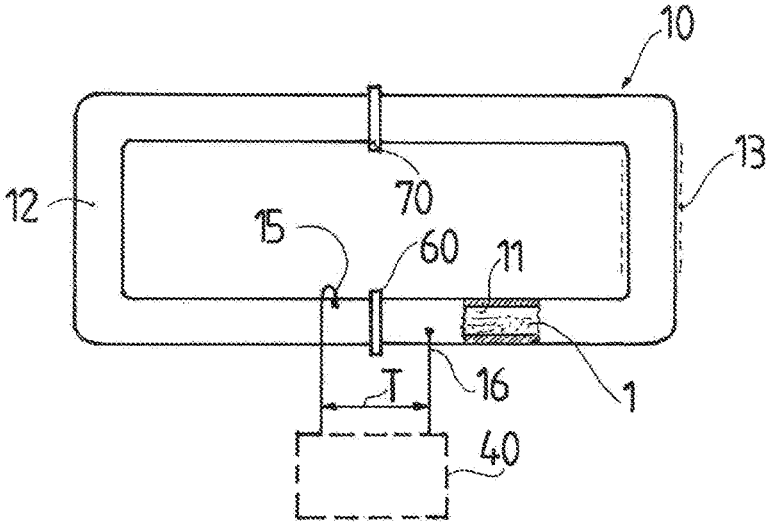
FIG. 3 shows a schematic picture of yet another different embodiment of the installed fire extinguishing equipment supplied with a circulation unit according to the invention.

FIG. 3 presents a schematic view of the installed fire extinguishing equipment with a version of the storage body 10 where the pipeline 13 of the storage body 10 forms a single closed channel returning to itself. Here also the pipeline 13 has a charging inlet 15 and circulation outlet 16, but here the charging inlet 15 and the circulation outlet 16 are located in the boundary 12 of the pipeline 13 at a small distance "T" from each other. In the interest of appropriate operation, the separation fitting 60 is built into the pipeline 13 between the charging inlet 15 and the circulation outlet 16. The separation fitting 60 is a shut-off valve that is capable of forming a gas-tight seal in the pipe section between the charging inlet 15 and circulation outlet 16 for the entire cross-section of the internal space 11 of the pipeline 13.

In the case of the given embodiment the pipeline 13 also has a space-dividing fitting 70, which, similarly to the separation fitting 60, makes a gas-tight seal possible between two separated parts of the internal space 11 of the pipeline 13.

During the operation of the installed fire extinguishing equipment according to the invention illustrated in FIG. 1, the internal space 11 of the storage body 10 may be filled using a known extinguishing material production device with the liquid component of the ready fire extinguishing material 1 through the charging inlet 15 of the storage body. Then, using the presented unit, the liquid component of the fire extinguishing material may be mixed much more evenly with the propellant gas that may be dissolved in it than in the case of previous versions. Following this, the status of the pressure of the fire extinguishing material composition 1 and the internal space 11 may be monitored using the monitoring unit 20 displaying the physical and chemical characteristics of the fire extinguishing material composition 1 in the internal space 11.

In the course of monitoring at prescribed intervals, with the charging flow regulation body 30 of the charging inlet 15 and the circulation flow regulation body 50 of the circulation outlet 16 being open, and with the circulation pump 44 of the circulation unit 40 being started, the fire extinguishing material composition 1 located in the internal space 11 of the storage body 10 may be transported via the circulation outlet 16 of the storage body 10 through the return stub 42 of the circulation unit 40 into the circulation pipe 43 of the circulation unit 40.

Also, with the help of the gas introduced into the gas inlet fitting 45 through the nozzle 45*a* of the gas inlet fitting 45 of the circulation unit 40, while the fire extinguishing material composition 1 is being moved, with the appropriate adjustment of the pressure regulation part-unit 48 and the shut-off fitting 49, it may be saturated with the gas phase component, and so the content and condition of the fire extinguishing material composition 1 is suitable at all times for being transported from the internal space 11 of the storage body 10 through the pipe section 3 to the use location 2 for the purpose of extinguishing a fire.

The fire extinguishing material composition 1 introduced through the return stub 42 into the circulation pump 44 mixed with the gas phase component introduced into the circulation pipe 43 with the nozzle 45*a* of the gas inlet fitting 45 leaves the gas inlet fitting 45 in the direction of the feed stub 41 of the circulation unit 40. Then, progressing in the circulation pipe 43 through the feed stub 41 towards the charging inlet 15 of the storage body 10, it leaves the circulation unit 40. Finally, the conditioned fire extinguishing material composition 1 returns to the internal space 11 of the storage body 10 through the charging inlet 15.

The operation of the installed fire extinguishing equipment presented in FIG. 2 is largely similar to that presented in connection with FIG. 1. The only difference is that because of the given embodiment of the circulation unit 40, here the pipeline 13 performing the task of the storage body 10 may be filled with the fire extinguishing material composition 1 with the help of the circulation unit 40. In the interest of this, with the charging flow regulation body 30 of the charging inlet 15 of the pipeline 13 and the circulation flow regulation body 50 of the circulation outlet 16 being in open state, and the shut-off fitting 81 of the supply stub 80 connected to the circulation pipe 43 of the circulation unit 40 also being open and with the circulation pump 44 being started, the non-gas phase component of the fire extinguishing material composition 1 may be fed through the supply stub 80 into the circulation pipe 43.

The gas phase component of the fire extinguishing material composition 1 may be added from the gas tank 46 to the component flowing from the circulation pump 44 in the direction of the gas inlet fitting 45 with the help of the nozzle 45*a* of the gas inlet fitting 45, so that the non-gas phase component absorbs the gas phase component to the desired extent, and so in this way the fire extinguishing material composition 1 leaves the gas inlet fitting 45 in the circulation pipe 43 progressing towards the charging inlet 15.

The given circulation must be continued until the internal space 11 of the pipeline 13 is filled with the desired amount and consistency of the fire extinguishing material composition 1. Following this, with the charging flow regulation body 30 of the charging inlet 15 and the circulation flow regulation body 50 of the circulation outlet 16, as well as the shut-off fitting 81 and the shut-off fitting 49 being closed, the installed fire extinguishing equipment is ready to transport the fire extinguishing material composition 1 through the discharge outlets 14 to the use location 2.

During the conditioning of the fire extinguishing material composition 1 stored in the internal space 11 of the pipeline 13, in the way presented previously, with the charging flow regulation body 30 of the charging inlet 15 and the circulation flow regulation body 50 of the circulation outlet 16 being open, and the circulation pump 44 of the circulation unit 40 switched on, the fire extinguishing material composition 1 in the internal space 11 of the pipeline 13 may be transported through the circulation pipe 43 of the circulation unit 40, and, optionally, the fire extinguishing material composition 1 may be mixed with more gas phase component from the gas tank 46 with the help of the gas inlet fitting 45.

The physical and chemical characteristics of the fire extinguishing material composition 1 in the internal space 11 of the pipeline 13 and of the internal space 11 may be checked at all times using the monitoring unit 20, and so the conditioning of the fire extinguishing material composition 1 can always be carried out in the necessary time period.

With the installed fire extinguishing equipment in the arrangement according to FIG. 3, the conditioning of the fire extinguishing material composition 1, or, optionally, also the first filling of the pipeline 13 of the storage body 10 with fire extinguishing material composition 1 may be performed depending on the part-units of the circulation unit 40. For these operations, the separation fitting 60 interposed between the charging inlet 15 and the circulation outlet 16 must be closed, while the space-dividing fittings 70 installed in the pipeline 13 must be kept open. With the separation fitting 60 in closed status, a pipeline 13 is created, as essentially illustrated in FIG. 2, that is sealed off at the one end 13*c* and at the other end 13*d*, as with respect to the effect of a closed status separation fitting 60 it is equivalent to the end member 13*e* sealing off the one end 13*c* and the other end 13*d* of the pipeline 13 according to FIG. 2.

When the installed fire extinguishing equipment according to FIG. 3 is operated by using the space-dividing fitting 70 individual sections of the pipeline 13 filled with fire extinguishing material composition 1 may be isolated, and so in the case of extinguishing a fire the stock of fire extinguishing material composition 1 may be more economically handled. After the fire has been extinguished, the amount used may be more easily replaced at a lower cost. Replacement is an operation substantially equivalent to filling, the presentation of which has already been carried out when presenting the previous figures.

The installed fire extinguishing equipment fitted with a circulation unit according to the invention may be used to good effect in all cases when a large amount of ready fire extinguishing material composition comprising several components that is susceptible to settling and outgassing must be continuously kept in a condition ready for extinguishing in such a way so that the installed fire extinguishing equipment may be reliably, economically and very efficiently operated.

What is claimed is:

1. A fire extinguishing equipment comprising:

a pressure-resistant storage body including an internal space configured to house a fire extinguishing composition therein, with a circulation outlet disposed within the storage body and forming a channel to the internal space, and with a charging inlet disposed within the storage body and forming a channel to the internal space, the circulation outlet configured for removing the fire extinguishing composition from the internal space, and the charging inlet configured for filling the internal space of the storage body with the fire extinguishing composition;

a monitoring unit connected to the storage body, the monitoring unit configured to measure and regulate one or more physical characteristics;

at least one discharge outlet in communication with the internal space of the storage body and coupled to an extinguishing pipe section, the extinguishing pipe section disposed between the storage body and a use location, the at least one discharge outlet and the extinguishing pipe section configured to discharge the fire extinguishing composition from the internal space of the storage body to the use location; and a pressure-proof circulation unit coupled to the storage body via the circulation outlet and the charging inlet, the pressure-proof circulation unit configured to verify a working pressure of the storage body and to refill the storage body with a has phase component of the fire extinguishing composition, the pressure-proof circulation unit including:

a feed stub connected to the charging inlet, a return stub connected to the circulation outlet, and a circulation pipe disposed between the feed stub and the return stub, with a circulation pump and a gas inlet fitting disposed within the circulation pipe;

a gas tank connected to the gas inlet fitting, the gas tank configured to contain at least the gas phase component of the fire extinguishing composition, such that the gas tank introduces the gas phase component of the fire extinguishing composition to the circulation pipe, wherein the has phase component of the fire extinguishing composition is introduced to the fire extinguishing composition within the circulation pipe and refills the storage body via the charging inlet.

2. The fire extinguishing equipment of claim 1, wherein the charging inlet of the storage body is located on an upper part of a boundary of the storage body, and wherein the circulation outlet of the storage body is located on a lower part of the boundary of the storage body.

3. The fire extinguishing equipment of claim 2, wherein the feed stub of the circulation unit is connected to the internal space of the storage body via the upper part of the boundary.

4. The fire extinguishing equipment of claim 1, further comprising a manometer part-unit disposed within the circulation pipe of the circulation unit.

5. The fire extinguishing equipment of claim 1, wherein the gas tank is connected to the gas inlet fitting via the interposition of a pressure regulation part-unit or a shut-off fitting.

6. The fire extinguishing equipment of claim 1, wherein the storage body is established as a tank.

7. The fire extinguishing equipment of claim 1, wherein the storage body is established as an elongated pipeline containing at least two pipe sections oriented at a non-zero angle with respect to each other, wherein each end of the pipeline is sealed off with an end member, wherein the charging inlet of the storage body is disposed at a first end of the pipeline, and wherein the circulation outlet is disposed opposite the charging inlet at a second end of the pipeline.

8. The fire extinguishing equipment of claim 1, wherein the storage body is formed by a closed pipeline returning to itself, where the charging inlet and the circulation outlet are spaced apart from one another in the pipeline by a distance, further comprising a separation fitting disposed within the storage body between the charging inlet and the circulation outlet, wherein the internal space of the storage body is divided between the charging inlet and the circulation outlet.

9. The fire extinguishing equipment of claim 8, further comprising one or more space-dividing fittings disposed within the pipeline, wherein the internal space of the pipeline is divided into one or more space-parts.

10. The fire extinguishing equipment of claim 1, wherein the gas inlet fitting includes a nozzle that distributes the gas phase component of the fire extinguishing composition into the fire extinguishing composition.

11. The fire extinguishing equipment of claim 1, further comprising a supply stub fitted with a closing fitting that is connected to the circulation pipe of the circulation unit, wherein at least one component of the fire extinguishing composition that is not the gas phase component is introduced into the circulation pipe of the circulation unit through the supply stub.

* * * * *